US012357109B2

(12) United States Patent
Taylor et al.

(10) Patent No.: US 12,357,109 B2
(45) Date of Patent: Jul. 15, 2025

(54) INFANT SEAT WITH ANGLE ADJUSTMENT FUNCTION

(71) Applicant: WONDERLAND SWITZERLAND AG, Steinhausen (CH)

(72) Inventors: Andrew J. Taylor, Mohnton, PA (US); Daniel A. Sack, Pottstown, PA (US); Patrick J. G. Bowers, West Chester, PA (US); Curtis M. Hartenstine, Birdsboro, PA (US)

(73) Assignee: Wonderland Switzerland AG, Steinhausen (CH)

( * ) Notice: Subject to any disclaimer, the term of this patent is extended or adjusted under 35 U.S.C. 154(b) by 0 days.

(21) Appl. No.: 18/327,378

(22) Filed: Jun. 1, 2023

(65) Prior Publication Data

US 2023/0320494 A1 Oct. 12, 2023

Related U.S. Application Data

(63) Continuation of application No. 17/306,926, filed on May 3, 2021, now Pat. No. 11,700,952, which is a (Continued)

(51) Int. Cl.
*A47D 13/10* (2006.01)
*A47D 1/00* (2006.01)

(Continued)

(52) U.S. Cl.
CPC ..... *A47D 13/102* (2013.01); *A47D 1/002* (2013.01); *A47D 7/007* (2013.01); *A47D 7/04* (2013.01);

(Continued)

(58) Field of Classification Search
CPC ..... A47D 1/002; A47D 13/102; A47D 9/02; A47D 7/007; A47D 7/04; A47D 9/005
See application file for complete search history.

(56) References Cited

U.S. PATENT DOCUMENTS 5,028,061 A * 7/1991 Hawkes ..... B62B 7/147 280/47.4
5,299,818 A * 4/1994 Newbold ..... B62J 1/16 224/415

(Continued)

FOREIGN PATENT DOCUMENTS

CN 201200188 Y 3/2009
CN 102101491 A 6/2011
CN 104116355 A 10/2014

*Primary Examiner* — Anthony D Barfield
(74) *Attorney, Agent, or Firm* — Fay Kaplun & Marcin, LLP

(57) ABSTRACT

An infant seat includes a seat back member including an outer hub, a seat support member including an inner hub, a seat structure connected to the seat back member, and a locking mechanism including a slide gear and operably disposed on the seat back member. The inner hub is pivotably connected to the outer hub to make the seat back member rotatably connected to the seat support member for forming a cross bar structure. The slide gear is slidable within the outer and inner hubs for engaging with the outer and inner hubs to stop rotation of the inner hub on the outer hub. When the locking mechanism translates the slide gear to an unlocked position, the slide gear is disengaged from the outer hub to make the seat back member rotatable relative to the seat support member for adjusting a tilt angle of the seat structure.

16 Claims, 11 Drawing Sheets

Related U.S. Application Data continuation of application No. 16/403,623, filed on May 6, 2019, now Pat. No. 11,019,938.

(60) Provisional application No. 62/729,721, filed on Sep. 11, 2018, provisional application No. 62/667,863, filed on May 7, 2018.

(51) Int. Cl.

| | |
|---|---|
| ***A47D 7/00*** | (2006.01) |
| ***A47D 7/04*** | (2006.01) |
| ***A47D 9/00*** | (2006.01) |
| ***A47D 9/02*** | (2006.01) |

(52) U.S. Cl.

CPC ..... *A47D 9/005* (2013.01); *A47D 9/016* (2022.08); *A47D 9/02* (2013.01); *A47D 9/053* (2022.08); *A47D 13/101* (2022.08)

(56) References Cited

U.S. PATENT DOCUMENTS

| | | | | |
|---|---|---|---|---|
| 7,377,537 | B2 * | 5/2008 | Li | 280/47.38 |
| 2018/0070738 | A1 * | 3/2018 | Burns | |

* cited by examiner

INFANT SEAT WITH ANGLE ADJUSTMENT FUNCTION

CROSS REFERENCE TO RELATED APPLICATIONS

The present application is a Continuation of U.S. patent application Ser. No. 17/306,926 filed May 3, 2021 now U.S. Pat. No. 11,700,952; which is a Continuation of U.S. patent application Ser. No. 16/403,623 filed May 6, 2019, now U.S. Pat. No. 11,019,938; which claims priority to U.S. Provisional Patent Application Ser. Nos. 62/729,721 filed Sep. 11, 2018 and 62/667,863 filed May 7, 2018. The disclosures of the above application(s)/patent(s) are incorporated herewith by reference.

BACKGROUND OF THE INVENTION

1. Field of the Invention

The present invention relates to an infant seat, and more specifically, to an infant seat with an angle adjustment function.

2. Description of the Prior Art

In general, an infant seat is mounted on a support frame (e.g., a playard) for a caregiver to take care of an infant. However, since the infant seat usually serves a singular purpose as a changer, a napper, or a bassinet, it limits convenience of the infant seat in use.

SUMMARY OF THE INVENTION

The present invention provides an infant seat. The infant seat includes a seat back member, a seat support member, a seat structure, and a locking mechanism. The seat back member includes at least one outer hub. The at least one outer hub has a first gear tooth structure. The seat support member includes an inner hub corresponding to the at least one outer hub. The inner hub is pivotably connected to the at least one outer hub to make the seat back member rotatably connected to the seat support member for forming a cross bar structure. The inner hub has a second gear tooth structure. The seat structure is connected to the seat back member and forms a seating space. The locking mechanism is operably disposed between the seat back member and the seat support member. The locking mechanism includes a slide gear slidable within the at least one outer hub and the inner hub for engaging with the first gear tooth structure and the second gear tooth structure at a locked position to stop the inner hub of the seat support member from rotating relative to the at least one outer hub of the seat back member. The locking mechanism translates the slide gear to the locked position or an unlocked position. When the locking mechanism translates the slide gear to slide to the unlocked position, the slide gear is disengaged from the first gear tooth structure and engaged with the second gear tooth structure, to make the seat back member rotatable relative to the seat support member by a rotation of the inner hub on the at least one outer hub for adjusting a tilt angle of the seat structure.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
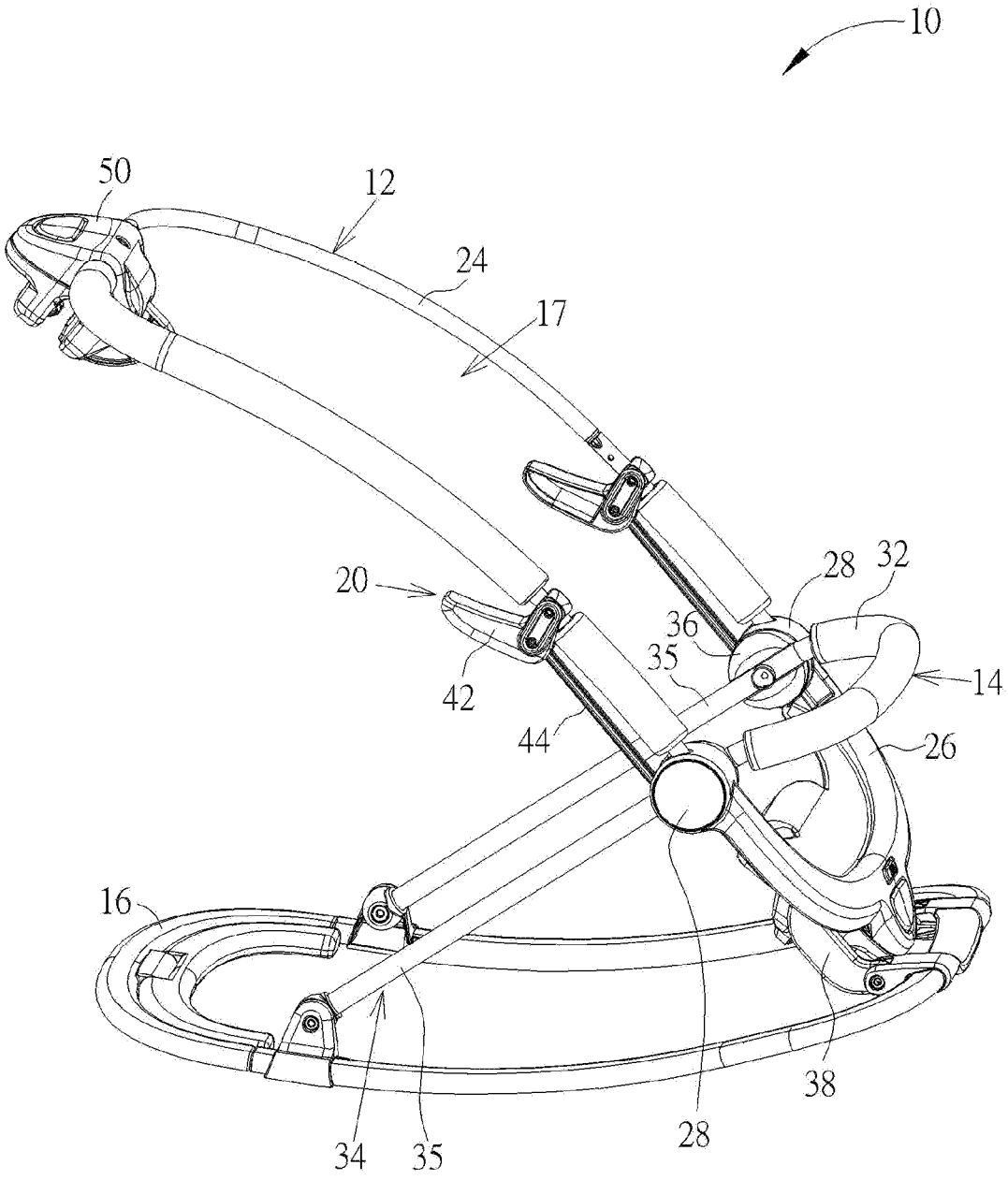
FIG. 1 is a diagram of an infant seat according to an embodiment of the present invention.
Figure 2:
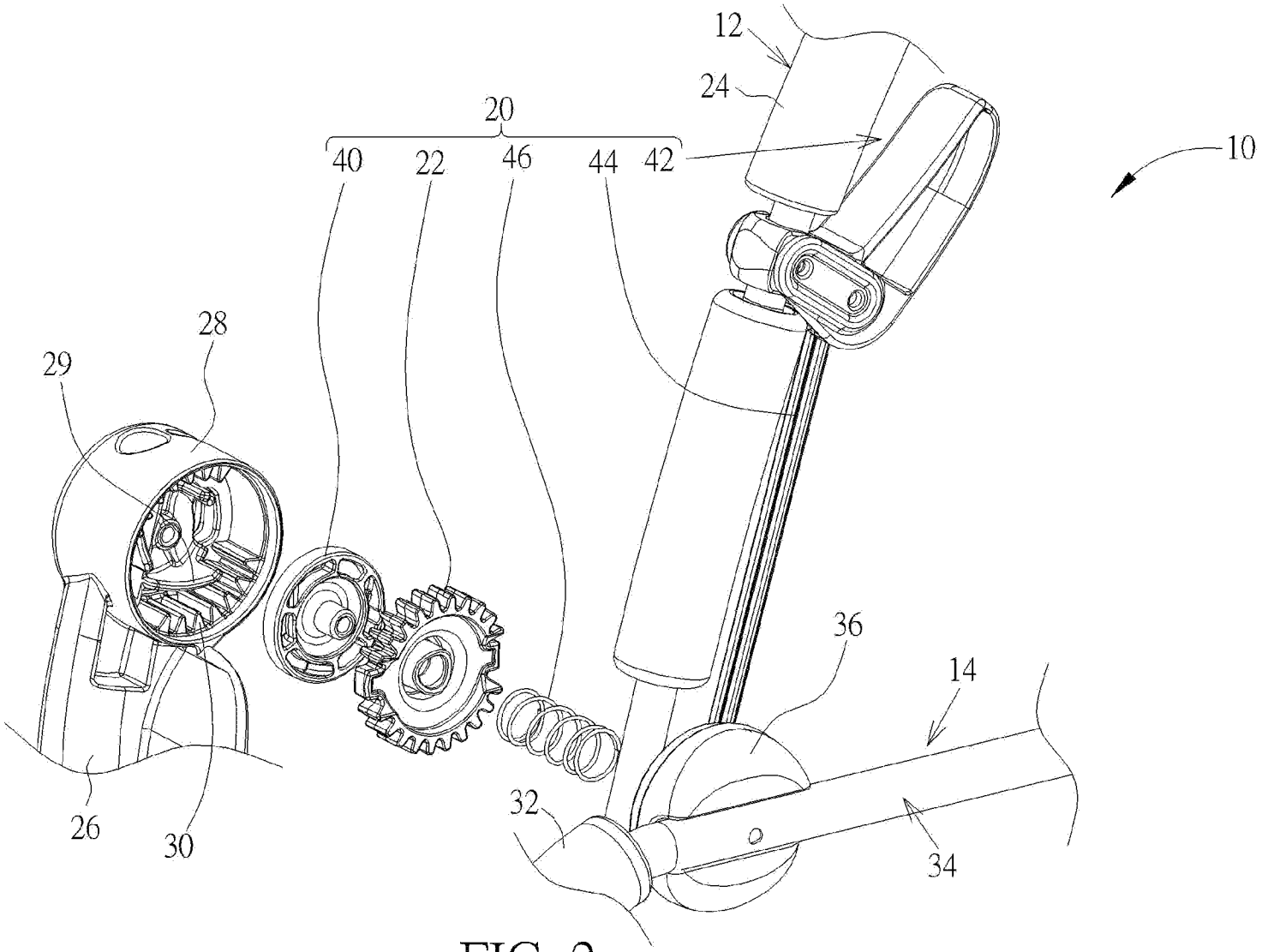
FIG. 2 is a partial exploded diagram of the infant seat in FIG. 1.
Figure 3:
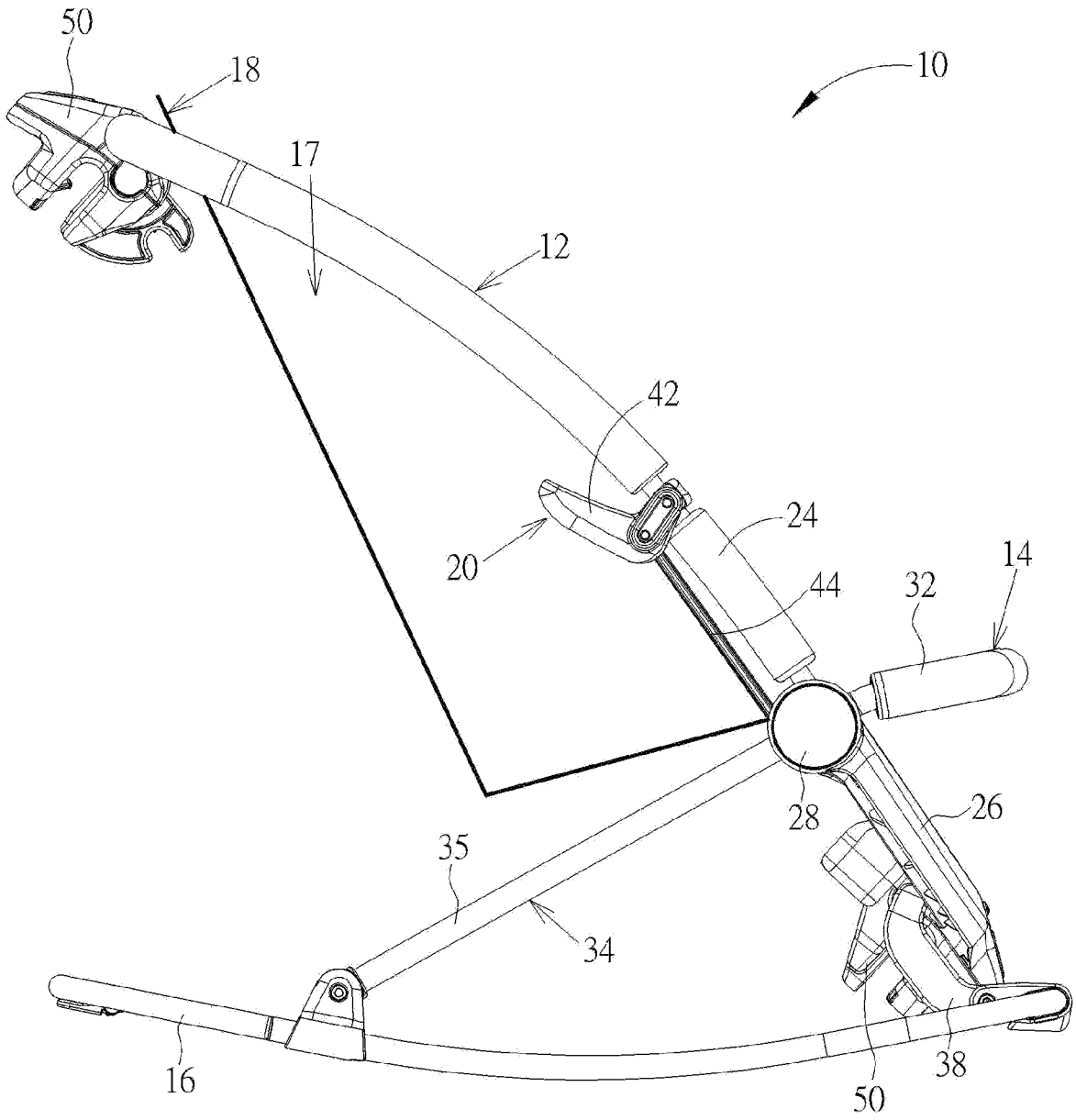
FIG. 3 is a side view of the infant seat in FIG. 1.

Please refer to FIG. 1, FIG. 2, and FIG. 3. FIG. 1 is a diagram of an infant seat 10 according to an embodiment of the present invention. FIG. 2 is a partial exploded diagram of the infant seat 10 in FIG. 1. FIG. 3 is a side view of the infant seat 10 in FIG. 1. For more clearly showing the mechanical design of the infant seat 10, a seat structure 18 is omitted in FIGS. 1-2 and is briefly depicted by bold lines in FIG. 3. As shown in FIGS. 1-3, the infant seat 10 includes a seat back member 12, a seat support member 14, a base member 16, the seat structure 18, and a locking mechanism 20 including a slide gear 22. The seat back member 12 has a seatback tube portion 24, a front connection portion 26, and at least one outer hub 28 (two shown in FIGS. 1-2, but not limited thereto), and the related description for the outer hub 28 at the right side of the infant seat 10 is provided as follows (as for the outer hub 28 at the left side of the infant seat 10, the related description could be reasoned by analogy and omitted herein). The outer hub 28 is connected between the seatback tube portion 24 and the front connection portion 26. The outer hub 28 has a first gear tooth structure 30 formed therein. The seat support member 14 has a seat front portion 32, a support strut portion 34 (preferably composed of two support strut tubes 35 in this embodiment, but not limited thereto), and an inner hub 36. The inner hub 36 is connected between the seat front portion 32 and the support strut portion 34 and pivotably connected to the outer hub 28 to make the seat back member 12 rotatably connected to the seat support member 14. The inner hub 36 has a second gear tooth structure 31 (not shown in FIG. 2 due to the viewing angle) similar to the first gear tooth structure 30.

The base member 16 is connected to the support strut portion 34, and the seat structure 18 is connected to the seat back member 12 and forms the seating space 17 for allowing a caregiver to place an infant thereon. In this embodiment, as shown in FIG. 3, the base member 16 could preferably be a rocker tube structure to remain a center of gravity of an infant sitting on the seat structure 18 close to a midpoint of an arc of the rocker tube structure, but not limited thereto, meaning that the base member 16 could be a non-rocking member or could toggle between a rocker and a non-rocking member in another embodiment.

Furthermore, the base member 16 could be further connected to the front connection portion 26 in this embodiment, but not limited thereto. That is, the infant seat 10 could further include a front link member 38 respectively pivoted to the front connection member 26 and the base member 16 to make the front connection portion 26 pivotable relative to the base member 16.

More detailed description for the mechanical design of the locking mechanism 20 is provided as follows. In this embodiment, the slide gear 22 is transversely slidable within the inner hub 36 and the outer hub 28 for engaging with the first gear tooth structure 30 and the second gear tooth structure 31 at a locked position to stop the inner hub 36 from rotating relative to the outer hub 28, and the locking mechanism 20 is operably disposed on the seat back member 12 to translate the slide gear 22 to the locked position or an unlocked position. To be more specific, as shown in FIG. 2, the outer hub 28 has at least one ramped surface structure 29 (one shown in FIG. 2, but not limited thereto) formed therein, and the locking mechanism 20 further includes a gear pusher 40, an actuator 42, and an actuator link 44. The gear pusher 40 is transversely slidable between the outer hub 28 and the slide gear 22. The actuator 42 is pivotally connected to the seatback tube portion 24, and the actuator link 44 is respectively pivoted to the actuator 42 and the gear pusher 40. To be noted, as shown in FIG. 2, the locking mechanism 20 could further include a spring 46. The spring 46 is respectively connected to the slide gear 22 and the inner hub 36 to bias the slide gear 22 to the locked position, so as to achieve the gear returning purpose and make engagement of the slide gear 22 with the inner hub 36 and the outer hub 28 more firm for safety.

In such a manner, when the actuator 42 is operated by a caregiver to rotate the gear pusher 40 via the actuator link 44, the gear pusher 40 transversely slides to the unlocked position along the ramped surface structure 29 for driving the slide gear 22 to be disengaged from the first gear tooth structure 30. Accordingly, since the slide gear 22 is no longer engaged with the first gear tooth structure 30, the seat back member 12 is rotatable relative to the seat support member 14 via rotation of the inner hub 36 on the outer hub 28 for adjusting a tilt angle of the seat structure 18. To be noted, the aforesaid actuator design could be also applied to the outer hub 28 and the inner hub 36 at the left side of the infant seat 10, and the related description could be reasoned by analogy according to FIG. 2 and omitted herein.

Figure 5:
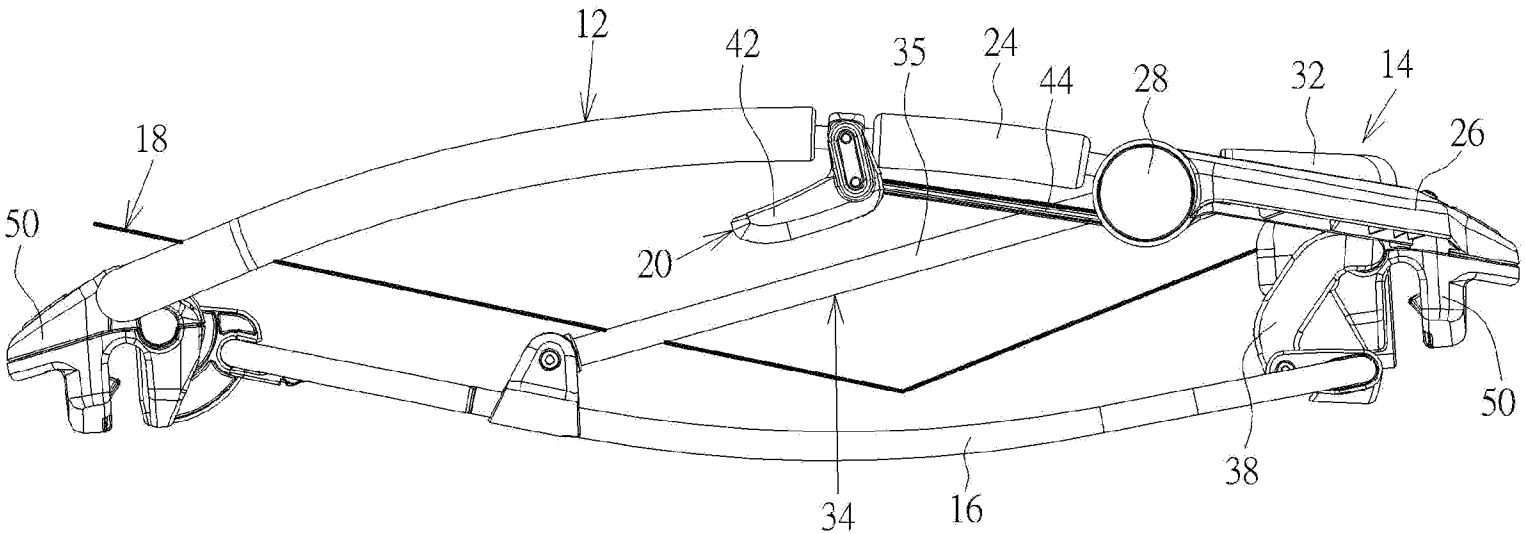
FIG. 5 is a side view of the seat back member in FIG. 3 rotating to a lying position.

After the aforesaid unlocking operation is performed, the infant seat 10 can serve multiple purposes. For example, when the caregiver wants an infant to lie flat on the seat structure 18, the caregiver just needs to rotate the seat back member 12 to a lying position as shown in FIG. 5. Subsequently, the caregiver can release the actuator 42, and then the spring 46 can bias the slide gear 22 to be engaged with the first gear tooth structure 30 and the second gear tooth structure 31 at the locked position to stop the inner hub 36 from rotating relative to the outer hub 28, such that the seat back member 12 can be located at the lying position as shown in FIG. 5 steadily. In such a manner, the caregiver can switch the infant seat 10 to a sleep mode to help the infant lie flat on the seat structure 18, so as to make the infant feel more comfortable while the infant is sleeping.

On the other hand, when the caregiver wants the infant to sit on the seat structure 18 to do some activities, the caregiver just needs to press the actuator 42 and then rotate the seat back member 12 to a sitting position as shown in FIG. 3. Subsequently, the caregiver can release the actuator 42 to stop the inner hub 36 from rotating relative to the outer hub 28, such that the seat back member 12 can be located at the sitting position as shown in FIG. 3 steadily. Accordingly, the caregiver can switch the infant seat 10 to an activity mode to help the infant sit on the seat structure 18 snugly.

Figure 4:
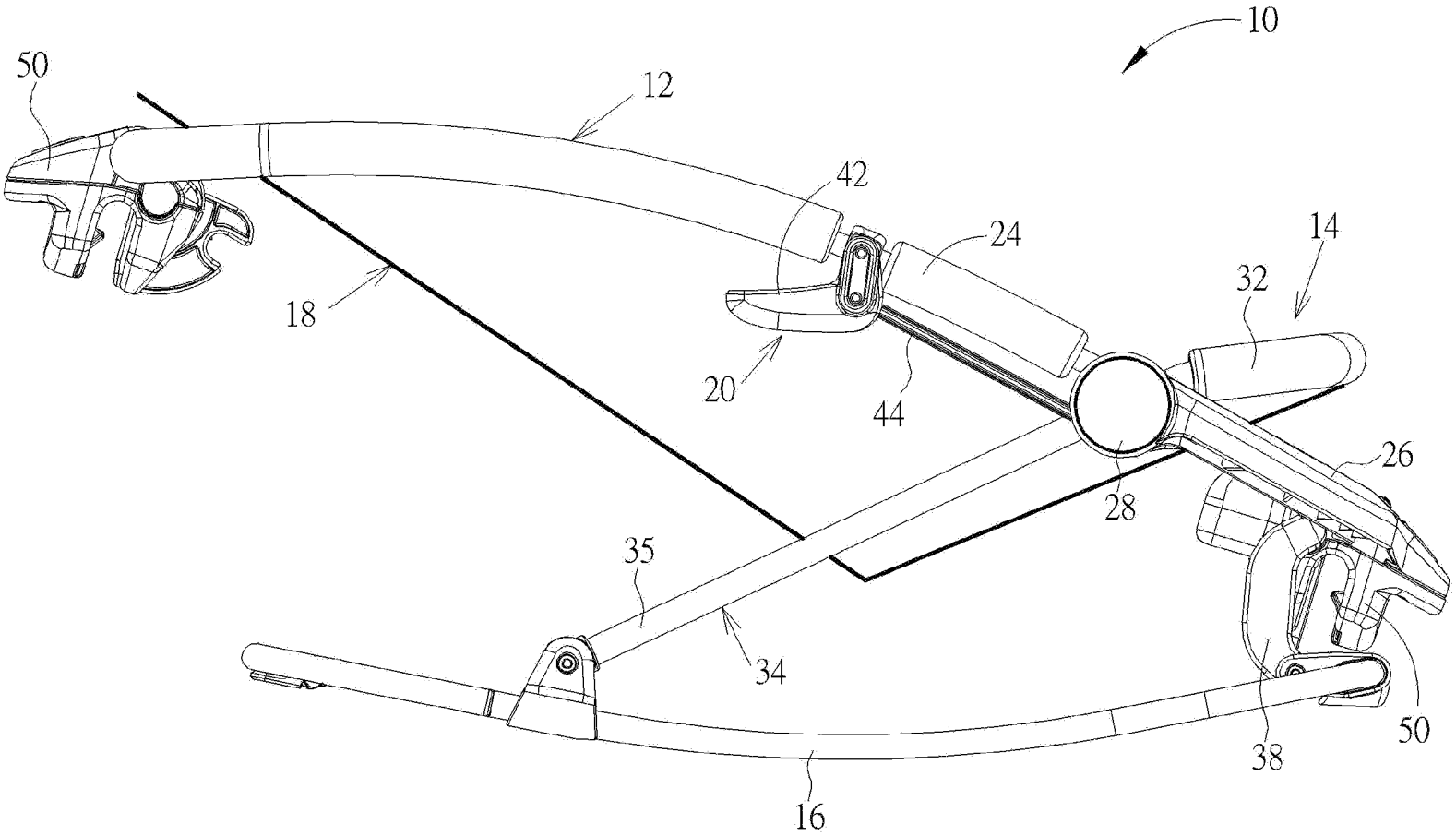
FIG. 4 is a side view of a seat back member in FIG. 3 rotating to a recline position.

Furthermore, if the caregiver just wants the infant to take a nap on the seat structure 18, the caregiver just needs to press the actuator 42 and then rotate the seat back member 12 to a recline position as shown in FIG. 4. Subsequently, the caregiver can release the actuator 42 to stop the inner hub 36 from rotating relative to the outer hub 28, such that the seat back member 12 can be located at the recline position as shown in FIG. 4 steadily. Accordingly, the caregiver could switch the infant seat 10 to a nap mode to help the infant recline on the seat structure 18, so as to make the infant feel more comfortable while the infant takes a nap.

In summary, compared with the infant seat provided by the prior art only serving a singular purpose as a changer, a napper, or a bassinet, the present invention adopts the design that the locking mechanism can be operated to translate the slide gear for making the seat back member rotatably relative to the seat support member at different tilt angles such that the infant seat can be capable of serving multiple infant care purposes. Thus, the present invention can greatly enhance convenience of the infant seat in use.

Figure 6:
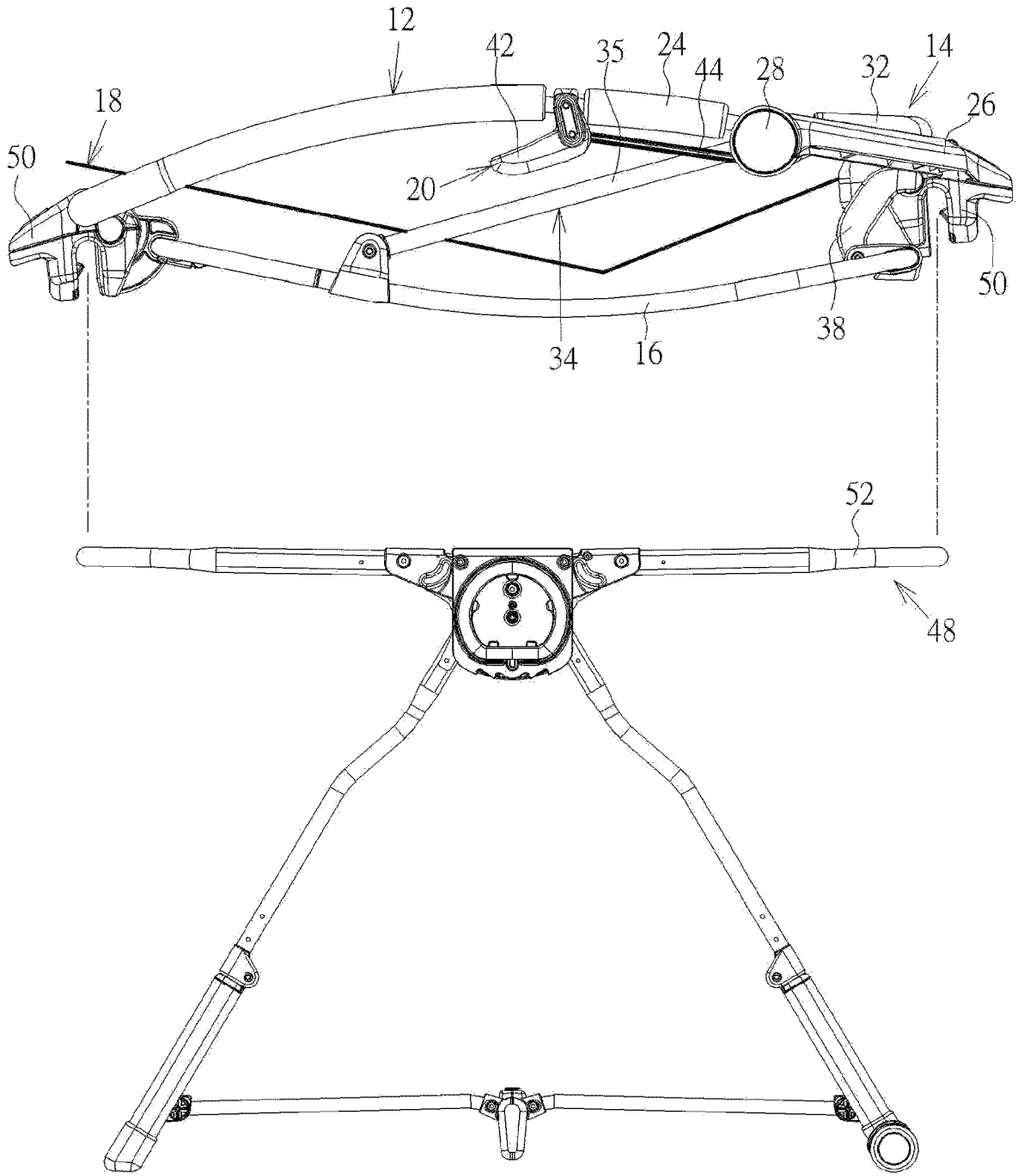
FIG. 6 is a side view of the infant seat in FIG. 5 and a playard.

In practical application, the infant seat 10 can utilize an engaging tool (e.g. a C-shaped jig or playard attachments 50 as shown in FIG. 6, but not limited thereto) for mounting on a playard. For example, please refer to FIG. 6, which is a side view of the infant seat 10 in FIG. 5 and a playard 48 (briefly depicted in FIG. 6). As shown in FIG. 6, the infant seat 10 could further include a pair of playard attachments 50 disposed at opposite sides of the seat back member 12. In this embodiment, the two playard attachments 50 are disposed at the seatback tube portion 24 and the front connection portion 26 respectively for detachably engaging with a top rail 52 of the playard 48. As such, the infant seat 10 can be mounted on the playard 48 for infant care when the tilt angle of the seat structure 18 is adjusted to keep the seat structure 18 at the lying position as shown in FIG. 6.

Figure 7:
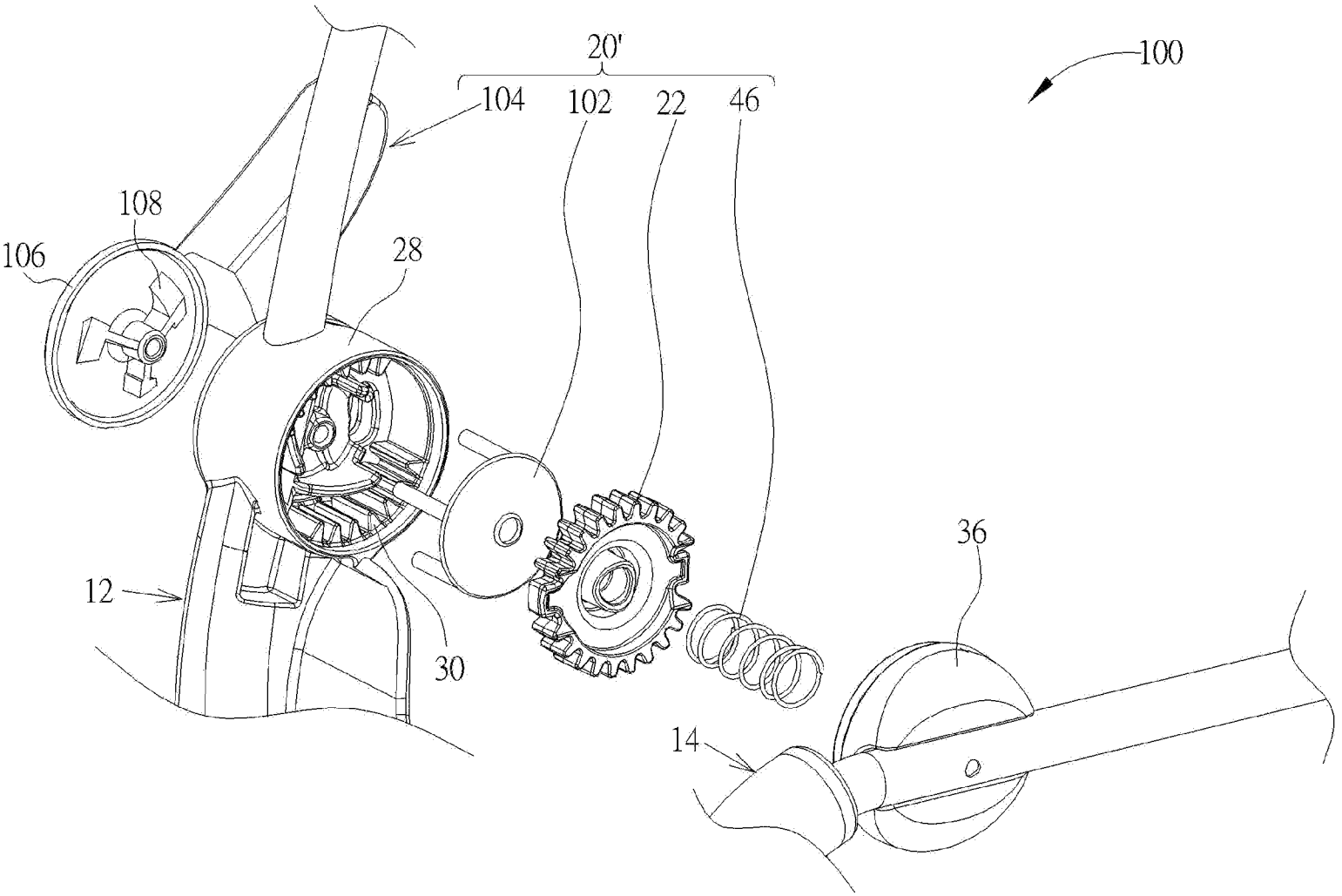
FIG. 7 is a partial exploded diagram of an infant seat according to another embodiment of the present invention.

It should be mentioned that the locking mechanical design is not limited to the aforesaid embodiment. For example, please refer to FIG. 7, which is a partial exploded diagram of an infant seat 100 according to another embodiment of the present invention. Components both mentioned in this embodiment and the aforesaid embodiment represent components with similar structures or functions, and the related description is omitted herein. As shown in FIG. 7, the infant seat 100 includes the seat back member 12, the seat support member 14, the base member 16, the seat structure 18, and a locking mechanism 20' (the base member 16 and the seat structure 18 not shown in FIG. 7). The locking mechanism 20' includes the slide gear 22, a gear pusher 102, an actuator 104, and the spring 46. The gear pusher 102 is transversely slidable between the outer hub 28 and the slide gear 22, and the actuator 104 has a pivot hub 106. The pivot hub 106 is pivoted to the outer hub 28 and has at least one ramped surface structure 108 (one shown in FIG. 7, but not limited thereto) formed therein.

In such a manner, when the actuator 104 is operated by the caregiver to rotate the pivot hub 106, the ramped surface structure 108 forces the gear pusher 102 against the slide gear 22, which means that the gear pusher 102 is pressed against the slide gear 22 by leaning on the ramped surface structure 108, for driving the slide gear 22 to be disengaged from the first gear tooth structure 30 of the outer hub 28. Since the slide gear 22 is no longer engaged with the first gear tooth structure 30, the seat back member 12 is rotatable relative to the seat support member 14 via rotation of the inner hub 36 on the outer hub 28 for adjusting the tilt angle of the seat structure 18. Accordingly, the caregiver can switch the infant seat 100 to the sleep mode, the activity mode, or the nap mode mentioned in the aforesaid embodiment, such that the infant seat 100 can be capable of serving multiple infant care purposes. Thus, the present invention can greatly enhance convenience of the infant seat 100 in use.

Figure 8:
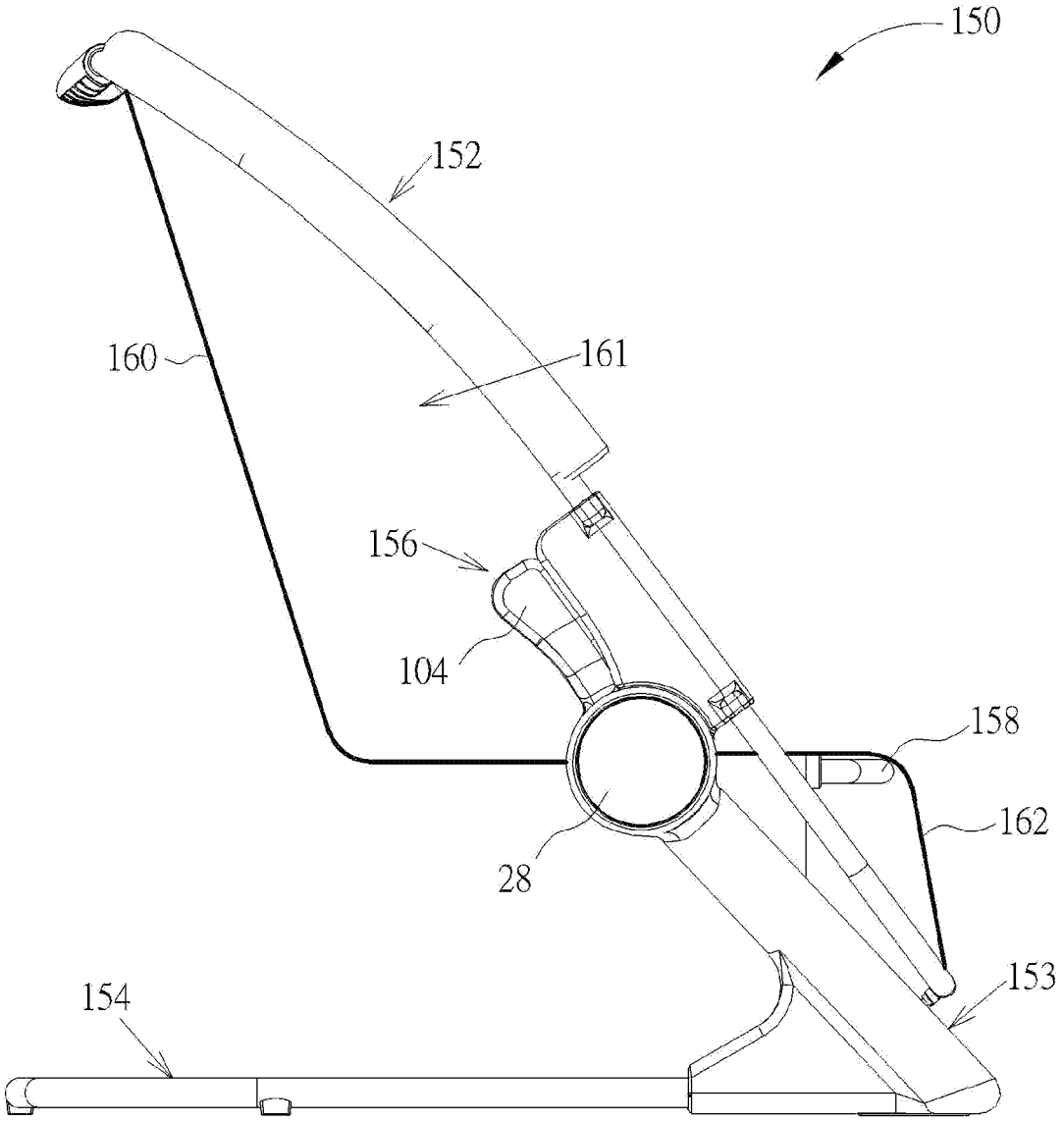
FIG. 8 is a side view of an infant seat according to another embodiment of the present invention.
Figure 9:
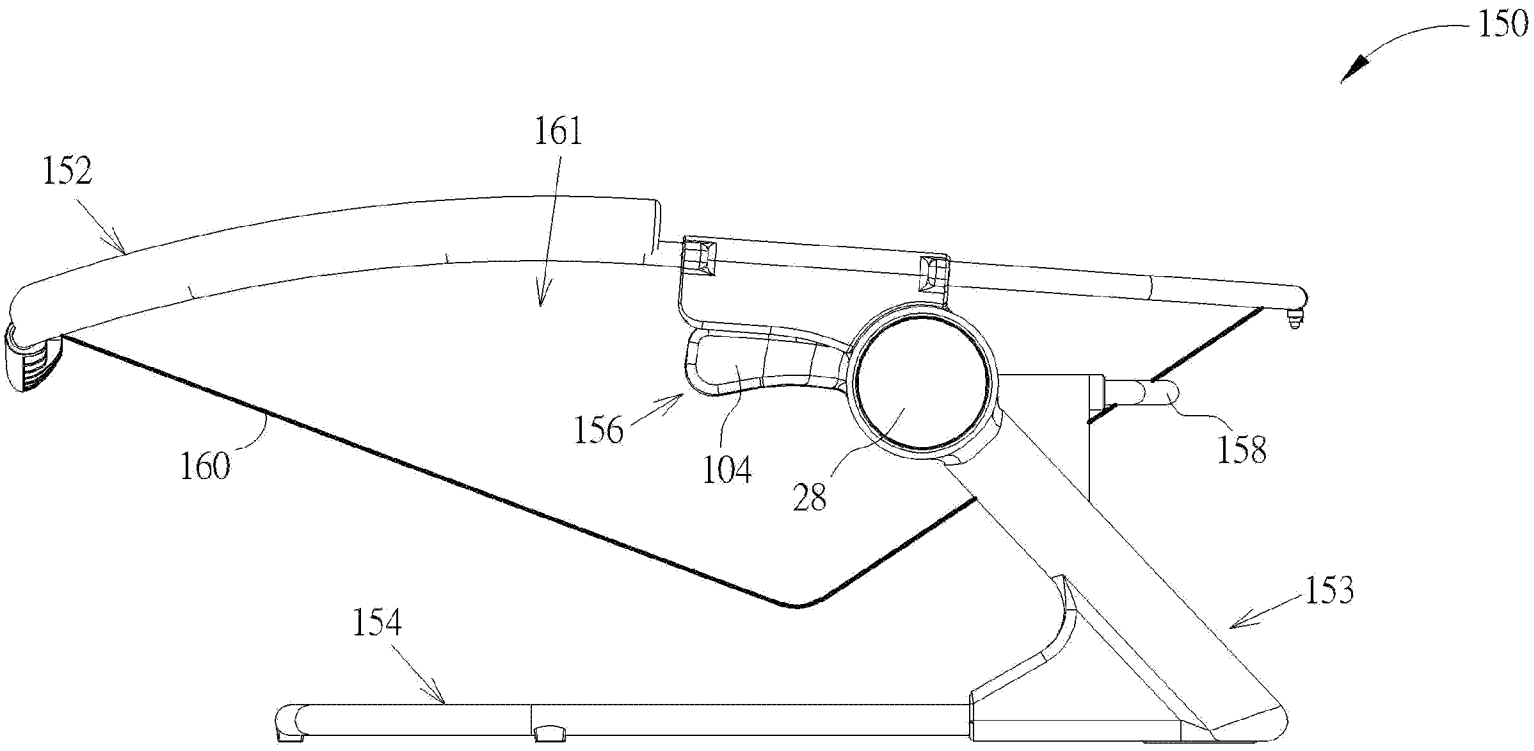
FIG. 9 is a side view of a seat back member in FIG. 8 rotating to a lying position.

Furthermore, the mechanical design of the infant seat is not limited to the aforesaid embodiments. For example, please refer to FIG. 8 and FIG. 9. FIG. 8 is a side view of an infant seat 150 according to another embodiment of the present invention. FIG. 9 is a side view of a seat back member 152 in FIG. 8 rotating to a lying position. Components both mentioned in this embodiment and the aforesaid embodiment represent components with similar structures or functions, and the related description is omitted herein. As shown in FIG. 8 and FIG. 9, the infant seat 150 includes the seat back member 152, a seat support member 153, a base member 154, a locking mechanism 156, a seat front tube 158, and a seat structure 160 (briefly depicted by bold lines in FIGS. 8-9). The seat back member 152 includes the outer hub 28, and the seat support member 153 includes the inner hub 36 (not shown in FIGS. 8-9). The base member 154 is connected to the seat support member 153. The locking mechanism 156 is operably disposed between the seat back member 152 and the seat support member 153 to translate the slide gear 22 (not shown in FIGS. 8-9) to the locked position for stopping the seat back member 152 from rotating relative to the seat support member 153, or to the unlocked position for making the seat back member 152 rotatable relative to the seat support member 153. In this embodiment, the seat structure 160 is a fabric body and the seat front tube 158 extends forwardly from the seat support member 153. The seat structure 160 is attached to a perimeter of the seat back member 152 to form a seating space 161. To be noted, the locking mechanism 156 could adopt the locking mechanical design of the locking mechanism 20' including the slide gear 22, the gear pusher 102, the actuator 104 and the spring 46 (the gear pusher 102 and the spring 46 also not shown in FIGS. 8-9) in this embodiment, or could adopt the locking mechanical design of the locking mechanism 20 including the slide gear 22, the gear pusher 40, the actuator 42, the actuator link 44, and the spring 46 in another embodiment. The related description could be reasoned by analogy according to the aforesaid embodiments and therefore omitted herein.

Via the aforesaid design, when the caregiver operates the actuator 104 of the lock mechanism 156 to rotate the seat back member 152 to the sitting position as shown in FIG. 8 for making the seat structure 160 cover the seat front tube 158, the seat structure 160 is drawn across the seat front tube 158 to define a front edge 162 of the infant seat 150 for the leg rest purpose while the infant is sitting on the seat structure 160. On the other hand, when the caregiver operates the actuator 104 of the lock mechanism 156 to rotate the seat back member 152 to the lying position as shown in FIG. 9, the caregiver can switch the infant seat 150 to a sleep mode to help the infant lie flat on the seat structure 160 in a slung shape, so as to make the infant feel more comfortable while the infant is sleeping.

To be noted, the aforesaid engaging tool design could be applied to the infant seat 150. In brief, the infant seat 150 can utilize an engaging tool (e.g. a C-shaped jig or the playard attachments 50 as shown in FIG. 6, but not limited thereto) to be mounted on a playard for infant care when the tilt angle of the seat structure 160 is adjusted to keep the seat structure 160 at the lying position as shown in FIG. 9.

Figure 10:
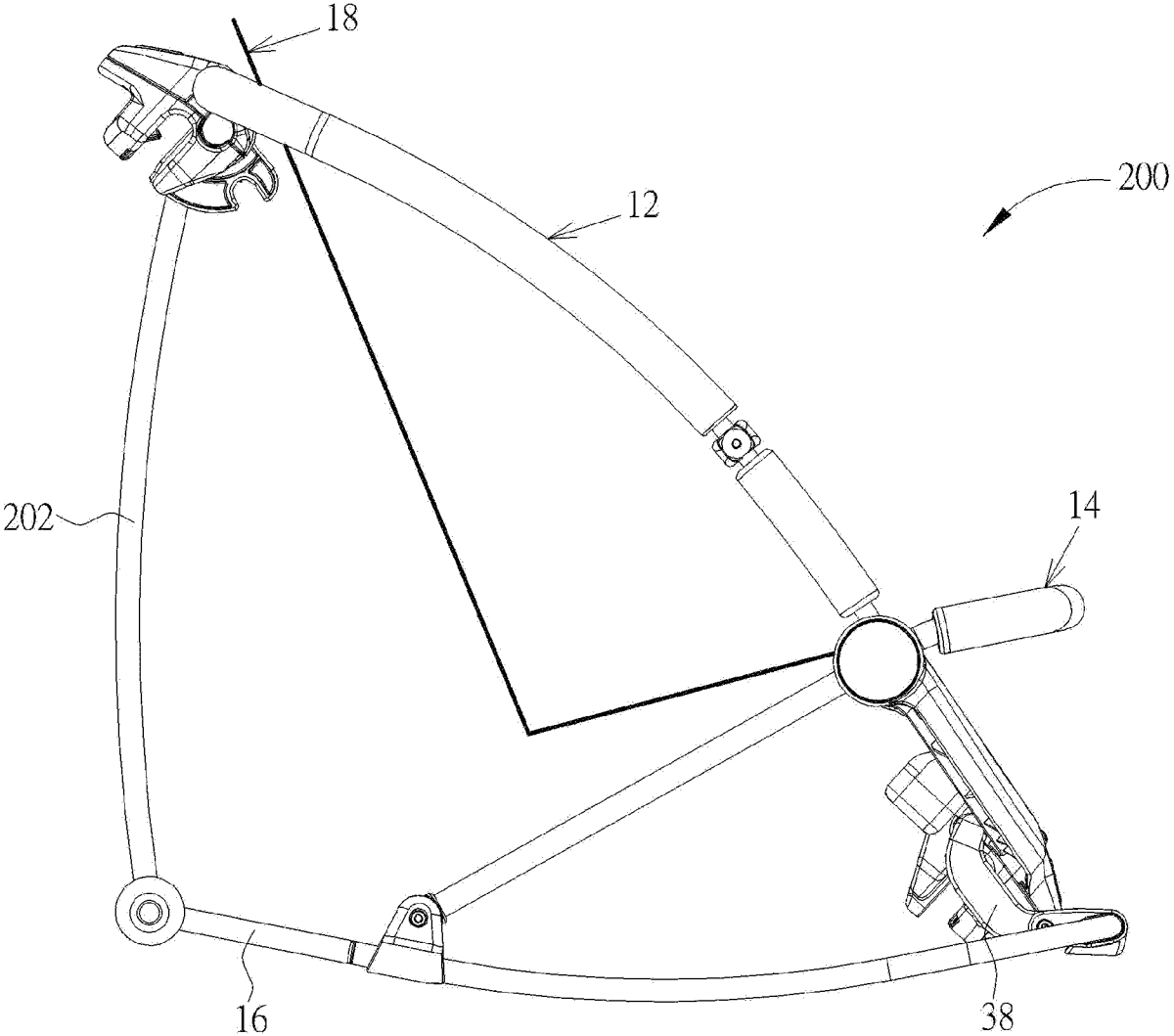
FIG. 10 is a side view of an infant seat according to another embodiment of the present invention.

Moreover, the present invention could adopt a simple pivot rod design. For example, please refer to FIG. 10, which is a side view of an infant seat 200 according to another embodiment of the present invention. Components both mentioned in this embodiment and the aforesaid embodiments represent components with similar structures or functions, and the related description is omitted herein. As shown in FIG. 10, the infant seat 200 includes the seat back member 12, the seat support member 14, the base member 16, the seat structure 18, and a pivot rod 202. The pivot rod 202 is pivoted to the base member 16 and is detachably connected to the seat back member 12. Accordingly, when the caregiver wants the infant to sit on the seat structure 18 to do some activities, the caregiver just needs to rotate the seat back member 12 to a sitting position as shown in FIG. 10. Subsequently, the caregiver can connect the pivot rod 202 to the seat back member 12 for supporting the seat back member 12 at the sitting position steadily, such that the caregiver can switch the infant seat 200 to an activity mode to help the infant sit on the seat structure 18 snugly. As for the related description for the other angle adjustment operations (e.g. switching to a sleep mode) of the infant seat 200, it could be reasoned by analogy according to the aforesaid embodiments and omitted herein.

Figure 11:
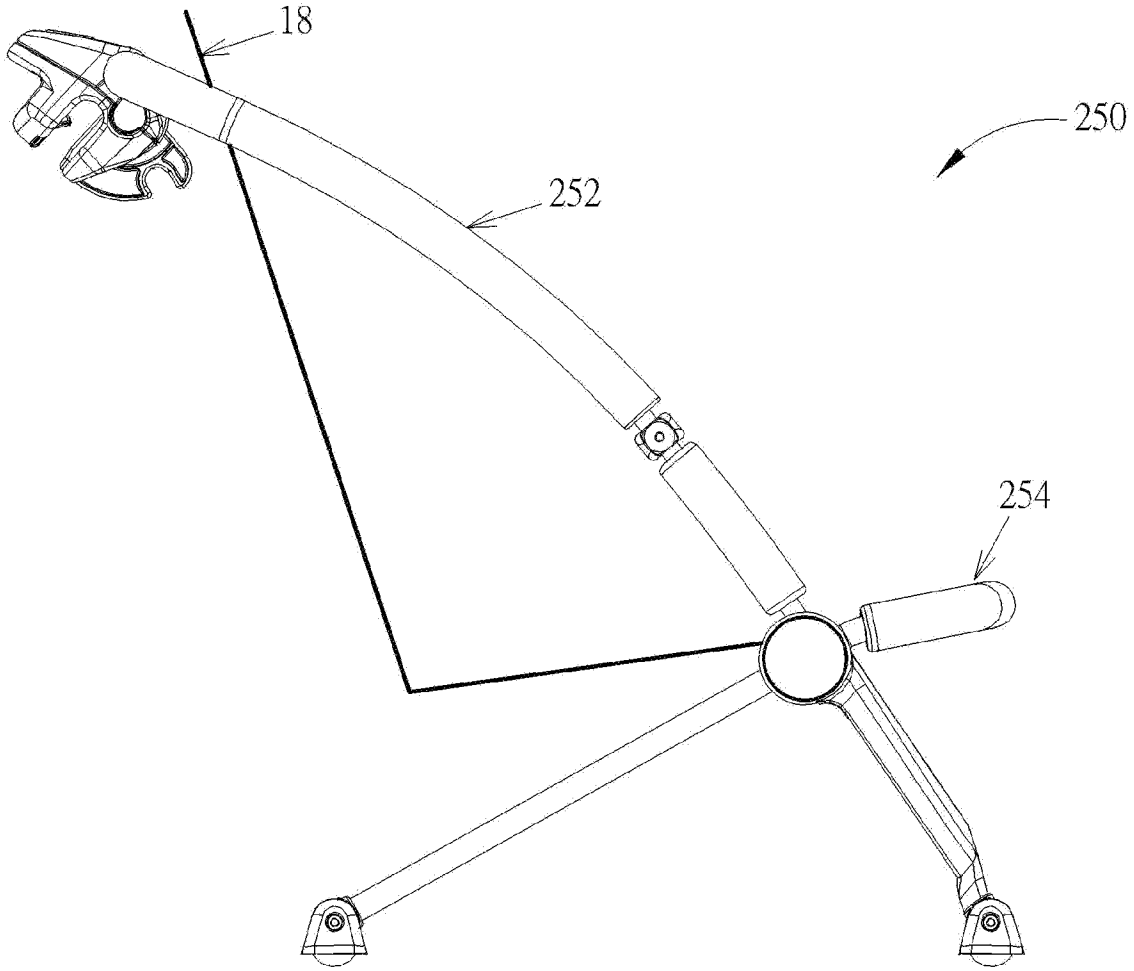
FIG. 11 is a side view of an infant seat according to another embodiment of the present invention.

In addition, the present invention could adopt a simple cross bar design. For example, please refer to FIG. 11, which is a side view of an infant seat 250 according to another embodiment of the present invention. Components both mentioned in this embodiment and the aforesaid embodiments represent components with similar structures or functions, and the related description is omitted herein. As shown in FIG. 11, the infant seat 250 includes the seat back member 252, the seat support member 254, and the seat structure 18. The seat back member 252 is rotatably intersected with the seat support member 254. Accordingly, when the caregiver wants the infant to sit on the seat structure 18 to do some activities, the caregiver just needs to rotate the seat back member 252 to a sitting position as shown in FIG. 11. At this time, the seat back member 252 can form a cross bar cooperatively with the seat support member 254 for supporting the seat back member 252 at the sitting position steadily, such that the caregiver can switch the infant seat 250 to an activity mode to help the infant sit on the seat structure 18 snugly. As for the related description for the other angle adjustment operations (e.g. switching to a sleep mode) of the infant seat 250, it could be reasoned by analogy according to the aforesaid embodiments and omitted herein.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A seat for a child, comprising:

a seat back member comprising a first hub having a first interlocking structure;

a seat support member comprising a second hub having a second interlocking structure, the second hub pivotably connected to the first hub to rotatably connect the seat back member to the seat support member; and a locking mechanism coupling the seat back member to the seat support member, the locking mechanism including a slide gear slidable within the first and second hubs configured to engage with the first and second interlocking structures at a locked position to stop the first and second hubs from rotating relative one another, the locking mechanism translating the slide gear between the locked position and an unlocked position via an actuator connected to one of the first and second hubs via a pivot hub which pivots relative to the one of the first and second hubs to rotate a gear pusher relative to a ramp structure of the actuator so that the gear pusher slides over the ramp structure and moves laterally against the slide gear to drive the slide gear to the unlocked position so that the seat back member is rotatable relative to the seat support member by rotation of the first and second hubs relative to one another.

2. The seat of claim 1, wherein the first interlocking structure includes a first gear tooth structure, the second interlocking structure including a second gear tooth structure.

3. The seat of claim 1, further comprising:

a base member connected to the seat support member, the base member configured to support the seat on the ground.

4. The seat of claim 3, further comprising:

a seat structure connected to the seat back member and forming a seating space.

5. The seat of claim 4, wherein the base member is a rocker tube structure configured to remain a center of gravity of the child sitting on the seat structure close to a midpoint of an arc of the rocker tube structure.

6. The seat of claim 3, wherein the seat back member further includes a seatback tube portion and a front connection portion, the locking mechanism is connected between the front connection portion and the seatback tube portion, wherein the seat support member further includes a seat front portion and a support strut portion, wherein the locking mechanism is connected between the seat front portion and the support strut portion, and wherein the base member is connected to the support strut portion and the front connection portion respectively.

7. The seat of claim 6, wherein the actuator is disposed on the seatback tube portion.

8. The seat of claim 4, further comprising:

playard attachments disposed at opposite sides of the seat back member configured to be detachably engaged with a top rail of a playard to make the seat mounted on the playard when a tilt angle of the seat structure is adjusted to keep the seat structure at a lying position.

9. The seat of claim 4, further comprising:

a seat front tube extending forwardly from the seat support member, wherein the seat structure is a fabric body attached to a perimeter of the seat back member configured to form the seating space, and wherein when the locking mechanism is configured to rotatably operate the seat back member to a sitting position to make the fabric body cover the seat front tube, the fabric body being drawn across the seat front tube to define a front edge of the seat.

10. A child seat, comprising:

a seat back member;

a seat support member pivotably connected to the seat back member;

a seat structure connected to the seat back member and forming a seating space;

a base member connected to the seat support member, the base member configured to support the seat on the ground; and a locking mechanism rotatably coupling the seat back member to the seat support member, the locking mechanism configured to provide a locked position to stop the seat back member and the seat support member from rotating relative one another, the locking mechanism configured to provide an unlocked position so that the seat back member is rotatable relative to the seat support member, and the locking mechanism comprising an actuator coupled to the locking mechanism via a pivot hub that rotates, upon actuation of the actuator to move the locking mechanism to the unlocked position, wherein the seat back member includes a first hub having a first gear tooth structure, wherein the seat support member includes a second hub pivotably connected to the first hub to rotatably connect the seat back member to the seat support member, the second hub having a second gear tooth structure, and wherein the locking mechanism includes a slide gear slidable within the first and second hubs configured to engage with the first gear tooth structure and the second gear tooth structure at the locked position to stop the first and second hubs from rotating relative one another.

11. The child seat of claim 10, wherein the base member is a rocker tube structure to remain a center of gravity of a child sitting on the seat structure close to a midpoint of an arc of the rocker tube structure.

12. The child seat of claim 10, wherein the seat back member further comprises a seatback tube portion and a front connection portion, wherein the locking mechanism is connected between the front connection portion and the seatback tube portion, wherein the seat support member further comprises a seat front portion and a support strut portion, wherein the locking mechanism is connected between the seat front portion and the support strut portion, and wherein the base member is connected to the support strut portion and the front connection portion respectively.

13. The child seat of claim 12, wherein the actuator is disposed on the seatback tube portion.

14. The child seat of claim 10, further comprising:

a pair of playard attachments disposed at opposite sides of the seat back member for detachably engaging with a top rail of a playard to make the child seat mounted on the playard when a tilt angle of the seat structure is adjusted to keep the seat structure at a lying position.

15. The child seat of claim 10, further comprising:

a seat front tube extending forwardly from the seat support member, wherein the seat structure is a fabric body attached to a perimeter of the seat back member for forming the seating space and wherein when the locking mechanism is operated to rotate the seat back member to a sitting position to make the fabric body cover the seat front tube, the fabric body being drawn across the seat front tube to define a front edge of the seat.

16. The child seat of claim 10, wherein the locking mechanism translates the slide gear between the locked position and the unlocked position via the actuator pivotally connected to one of the first and second hubs to move a ramp structure of the actuator to drive the slide gear to the unlocked position so that the seat back member is rotatable relative to the seat support member by rotation of the first and second hubs relative to one another.

* * * * *